United States Patent [19]

Reid

[11] Patent Number: 4,981,495

[45] **Date of Patent: * Jan. 1, 1991**

[54] METHODS FOR STABILIZING GASOLINE MIXTURES

[75] Inventor: Dwight K. Reid, Houston, Tex.

[73] Assignee: Betz Laboratories, Inc., Trevose, Pa.

[ * ] Notice: The portion of the term of this patent subsequent to Jul. 17, 2007 has been disclaimed.

[21] Appl. No.: 379,513

[22] Filed: Jul. 13, 1989

[51] Int. Cl.[5] ..... C10L 1/14

[52] U.S. Cl. ..... 44/333; 44/426; 44/435; 44/450; 44/437

[58] Field of Search ..... 44/65, 63, 76, 78, 70, 44/72

[56] References Cited

U.S. PATENT DOCUMENTS

| | | | |
|---|---|---|---|
| 3,901,849 | 8/1975 | Dodson et al. | 260/45.8 |
| 4,028,331 | 6/1977 | Hotta et al. | 260/45.8 |
| 4,124,655 | 11/1978 | Koehnlein et al. | 260/878 |
| 4,144,178 | 3/1979 | Katabe et al. | 252/8.9 |
| 4,158,000 | 6/1979 | Nagasaki et al. | 260/45.8 |
| 4,744,801 | 5/1988 | Taylor | 44/76 |
| 4,871,374 | 10/1989 | Weers | 44/63 |
| 4,941,968 | 7/1990 | Reid | 208/236 |

*Primary Examiner*—Margaret B. Medley

*Attorney, Agent, or Firm*—Alexander D. Ricci; Bruce E. Peacock

[57] ABSTRACT

Oxidative stability of gasoline mixtures is improved by adding to the gasoline an alkyl 1,2-dihydroquinoline compound, dimer, trimer or polymer thereof. Optionally, a hindered phenol may be conjointly used with the quinoline compound.

17 Claims, No Drawings

METHODS FOR STABILIZING GASOLINE MIXTURES

FIELD OF THE INVENTION

The present invention pertains to methods for increasing the oxidative stability of gasoline mixtures by the utilization of alkyl 1,2-dihydroquinoline compounds by themselves or conjointly with hindered phenols.

BACKGROUND OF THE INVENTION

Gasoline is defined as a complex mixture of hydrocarbons that is used as fuel for internal combustion engines. Gasoline manufactured today is derived from petroleum and is used in automobile, aircraft, marine engines and small engines designed for miscellaneous end-uses. The composition and characteristics of gasoline vary with the source, manufacturing method and end-use requirement of the product.

Gasoline was initially produced by the simple distillation of crude oil. The types of hydrocarbons found in such "straight-run" gasolines include paraffins, aromatics and napthenes (e.g., cycloparaffins). The number of carbon atoms in the hydrocarbon fraction molecules falling within the gasoline boiling range is usually from about $C_4$ to $C_{12}$.

Today, gasoline is produced in petroleum refineries by a plurality of processes. For example, fractional distillation is still used as one refinery method for gasoline production. However, the gasoline mixtures so produced are usually light in octane content and are therefore normally supplemented with gasolines produced by other methods to increase the octane content.

Other production methods include pyrolytic cracking wherein higher molecular weight hydrocarbons, such as those in gas oils, are either catalytically cracked or thermally cracked. Reforming is used to upgrade low-octane gasoline fractions into higher octane components by use of a catalyst. Alkylation of $C_3$ and $C_4$ olefins with isobutane is also practiced to provide a high octane content gasoline source.

Stripper gasoline is obtained by a process that uses steam injected into a fractionator column with the steam providing the heat needed for separation. The gasoline can come from either a hydrodesulfurizer (HDS) unit or a fluidized catalytic cracking (FCC) unit. Normally, stripper gasoline from a FCC unit is highly unstable and only small percentages thereof can be blended with a more stable gasoline product in order to obtain the final motor fuel product.

In isomerization techniques, low octane paraffins are converted to longer branched chain isomers. For instance, two hydrocarbon fractions such as isobutane and propylene are commonly combined to form isooctane in a process referred to as dimerization.

Despite the particular method of production, gasolines generally suffer from oxidative degradation. That is, upon storage, gasoline can form gummy, sticky resin deposits that adversely affect combustion performance. Further, such oxidative degradation may result in undesirable color deterioration.

Accordingly, it is an object of the present invention to provide a treatment for improving the oxidative stability of gasoline mixtures. Of even more importance is the provision of such a stabilizing treatment that is effective even when highly unstable gasoline mixtures, such as those formed via stripper and pyrolysis techniques, are treated.

SUMMARY OF THE INVENTION

The above and other objects of the invention are met by addition of an alkyl 1,2-dihydroquinoline compound or compounds to the desired gasoline mixture. Preferably, such compound comprises polymerized 2,2,4-trimethyl-1,2-dihydroquinoline (TMDH). Optionally, a hindered phenol, for instance, 2,6 di-t-butylphenol or 2,6-di-t-butyl-4-methylphenol, is conjointly used with the TMDH material.

Exemplary molar ratios of alkyl 1,2-dihydroquinoline:hindered phenol include from 2:1 to about 1:2 with about 1–10,000 ppm of the stabilizer treatment being added to the gasoline mixture per one million parts thereof.

PRIOR ART

The compound, 2,2,4-trimethyl-1,2-dihydroquinoline (TMDH) is not new. For instance, in U.S. Pat. No. 4,144,178 (Katabe et al), a polymeric form of the compound is used in combination with certain base oil materials in lubricating compositions that are applied to textile filaments or yarns to aid in spinning, drawing and other textile processes.

Similarly, TMDH monomer, dimer, and polymerization products thereof have been reported as being efficacious rubber antidegradants to prevent natural or synthetic rubbers from flex cracking and heat ageing in U.S. Pat. No. 4,158,000 (Nagasaki et al). The TMDH polymers may also, in accordance with U.S. Pat. No. 4,124,655 (Koehnlein et al), be used in electrical insulating compositions.

In U.S. Pat. No. 4,028,331 (Hotta et al), stabilized polyurethane resin compositions comprising varied hindered phenols and TMDH polymers are taught. The combination is useful in absorbing ultraviolet rays so as to increase the stability of readily degradable polyurethane resins. Table IV, No. 11, of this patent discloses the specific combination of 2,6-di-t-butyl-4-methylphenol and TMDH for such uses. A polymerized TMDH and tetrakis[methylene(3,5-di-t-butyl-4hydroxyhydrocinnamate)] methane combination has similarly been shown to stabilize polyolefin compositions in U.S. Pat. 3,901,849 (Dodson et al).

Accordingly, although TMDH has been used in a variety of different applications, it has not, to my knowledge, been utilized to lend stability to gasoline mixtures. As above stated, there is a need in the art to improve the stability of such mixtures, with an even more specific need existing in the area of highly unstable gasoline mixtures such as those formed via stripper and pyrolysis methods.

DETAILED DESCRIPTION OF THE PREFERRED EMBODIMENT

In accordance with the invention, gasoline mixtures, such as those formed via "straight-run", pyrolysis, reforming, alkylation, stripper, and isomerization techniques, are stabilized by adding to such gasoline mixtures an effective amount for the purpose of an alkyl 1,2-dihydroquinoline compound or polymerized alkyl 1,2-dihydroquinoline. In its monomeric form, the alkyl 1,2-dihydroquinoline compound has the structure

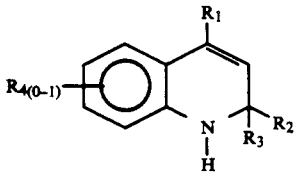

(I)

wherein $R_1$, $R_2$, and $R_3$ are the same or different and are chosen from H, and $C_1$–$C_6$ lower alkyl. $R_4$, when present, is $C_1$–$C_{20}$ alkyl or $C_1$–$C_{10}$ alkoxy.

Exemplary alkyl 1,2-dihydroquinolines include: 2,2,4-trimethyl-1,2-dihydroquinoline (T.M.D.H.)

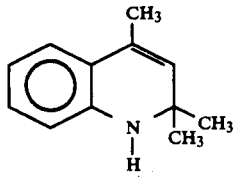

(II)

6-dodecyl-2,2,4-trimethyl-1,2-dihydroquinoline

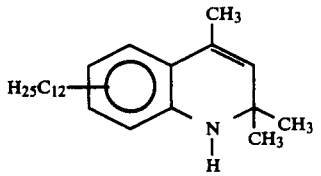

(III)

and 6-ethoxy-2,2,4-trimethyl-1,2-dihydroquinoline

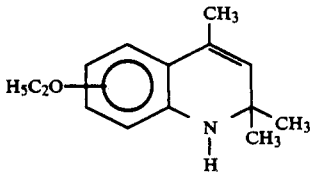

(IV)

Preferred for use is polymerized TMDH having the hypothesized structure

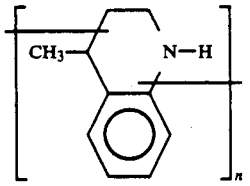

(V)

The alkyl 1,2-dihydroquinolines may be present in monomer, dimer, trimer or polymerized form. They are all well known and commercially available.

An reported in U.S. Pat. No. 4,158,000, the alkyl 1,2-dihydroquinolines are produced via reaction between aniline and acetones such as acetone, diacetone alcohol and mesityl oxide in the presence of an acidic catalyst. Mixtures of sundry alkyl 1,2-dihydroquinolines such as TMDH, TMDH dimer, and its polymer forms may be used.

TMDH polymers have been reported as having degrees of polymerization of from about 2 to 5. The polymerized products are light brown or cream colored powders. One such polymer reputedly has a molecular weight of about 500. The polymers are soluble in acetone, ethyl acetate, methylene chloride, carbon tetrachloride, benzene and ethanol and are insoluble in water.

The polymerized TMDH products are available from a plurality of manufacturer's and under a host of trademarks. For example, the patent literature indicates availability under the following trademarks: "Flectol H"—Monsanto, "Antigene RD"—Sumitomo Kogaku, "Antiage RD" Kawaguchi Kagaku, and "Noclarck 224"—Ouchi Shinko Kagaku. The particular TMDH polymer that I have used is available from Borg-Warner under the trademark "Ultranox 254". It is a cream-colored powder having a melting point of 75° C. and a density (20° C.) of 1.08 gm.

The alkyl 1,2-dihydroquinoline compounds are added to the gasoline mixture in an amount of 1–10,000 parts based upon 1 million parts of the gasoline mixture. Preferably about 1–1500 ppm are added. The compounds may be added under ambient conditions as a room or storage temperature stabilizer to stabilize the resulting gasoline mixture in tanks, drums, or any other storage or shipment container.

Preferably, the alkyl 1,2-dihydroquinoline compound(s) is conjointly used with a hindered phenol compound. By hindered phenol, I mean a phenolic compound having a substituent located on at least one of the ortho positions relative to the hydroxyl group. More preferably, such substituents are located on both of the ortho positions with an even more preferred hindered phenol having substituents on both ortho positions as well as the para position.

A wide variety of such substituents may be chosen. For example, the substituents may comprise $C_1$–$C_6$ alkyl, $C_1$–$C_{30}$ alkaryl, substituted $C_1$–$C_{30}$ alkaryl, thiophenol, substituted thiophenol, $C_1$–$C_{40}$ alkanoic acid ester, $C_1$–$C_6$ alkylamino, polynuclear aryl, substituted polynuclear aryl, $C_1$–$C_6$ alkoxy and amine groupings.

The hindered phenols, useful in accordance with the invention, may be represented by the structural formula

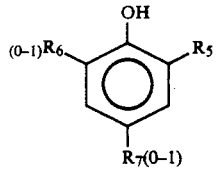

(VI)

wherein $R_5$ is selected from the group consisting of $C_1$–$C_6$ alkyl, $C_1$–$C_{30}$ alkaryl, and substituted $C_1$–$C_{30}$ alkaryl. $R_6$, when present, is independent from the substituent represented by $R_5$ but is also chosen from $C_1$–$C_6$ alkyl, $C_1$–$C_{30}$ alkaryl, and substituted $C_1$–$C_{30}$ alkaryl. $R_7$, when present, may be selected from $C_1$–$C_{20}$ alkyl, thiophenol, thio substituted phenol thiophenol $C_1$–$C_{40}$ alkanoic acid ester, $C_1$–$C_{30}$ alkaryl, sustituted $C_1$–$C_{30}$ alkaryl, $C_1$–$C_6$ alkylamino, $C_1$–$C_6$ alkoxy, amine, polynuclear aryl and substituted polynuclear aryl.

When $R_7$ is thio substituted phenol thiophenol, it has the structure

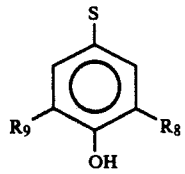

(VII)

with $R_8$ and $R_9$ being independently selected from $C_1$–$C_6$ alkyl.

At present, preferred hindered phenols include (1) 2,6-di-t-butyl-4-methylphenol (B.H.T.)

(2) mixtures of 2,6-di-t-butyl phenol (75%) and remainder tert-butyl phenol and tri-tert-butyl phenol and mixtures of B.H.T. with xylenol isomers (mixed dimethylphenol isomers)

The most preferred hindered phenol is BHT.

Other exemplary hindered phenols include:

4,4'-thiobis-(6-t-butyl-2-methylphenol)

octadecyl 3-(3',5'-di-t-butyl-4'-hydroxyphenyl) propionate 4,4'-methylenebis (2,6-di-t-butylphenol)

1,3,5-trimethyl 2,4,6-tris(3,5-di-t-butyl 4-hydroxybenzyl) benzene 2,6-di-t-butyl- dimethylamino-p-cresol 2,6-di-t-butyl-4-secbutyl phenol 2,2'-methylenebis (4-ethyl-6-t-butyl phenol)

2,2'-methylenebis (4-methyl-6-t-butyl phenol)

2,2'-methylenebis (6-(1-methylcyclohexyl)-p cresol); and 2,2'-methylenebis (4-methyl-6-cyclohexylphenol)

The molar ratio of alkyl 1,2-dihydroquinoline to hindered phenol that may be used in the conjoint stabilization treatment is from about 2:1 to 1:2, with from about 1–10,000 ppm of such combination being added to the gasoline. Preferably, the conjoint treatment is added in an amount of from 1–1,500 ppm of the combination.

Based upon presently available data, the composition preferred for use is a 1:1 molar ratio of polymerized TMDH and BHT.

In order to more clearly illustrate the invention, the data set forth below was developed. The following examples are included as being illustrations of the invention and should not be construed as limiting the scope thereof.

EXAMPLES

ASTM D 525-80 was utilized as the test procedure to demonstrate efficacy of the invention as a gasoline stabilizer. In accordance with this method, a gasoline sample is placed in a bomb along with the candidate gasoline stabilizer or, for purposes of control, no candidate gasoline stabilizer is added. The bomb is closed and oxygen is introduced into the bomb through a Schrader-type valve fitting until an over pressure of about 100 psig is attained. The bomb is then heated in a water bath to about 100° C. until a drop in pressure is noted signifying a loss of antioxidant activity. The period of time elapsing until a pressure drop is indicated is known as the "induction time", with longer induction times signifying increased stabilizer efficacy of the candidate material. Using this procedure, the following results were obtained using pyrolysis gasoline from a Texas refinery as the sample gasoline (Table I).

TABLE I

| | Pyrolysis Gasoline Texas Refinery | | |
|---|---|---|---|
| | Additive | Dosage (ppm active) | Induction Time (minutes) |
| | Control | — | 14, 14 |
| 1. | BHT | 200 | 37 |
| 2. | TMDH | 200 | 38 |
| 3. | BHT/TMDH (1:1) | 200 | 103 |
| 4. | Phenolic Mixture A | 200 | 23 |
| 5. | Phenolic Mixture A/TMDH (1:1) | 200 | 56 |
| 6. | BHT/Xylenol Isomers (1:1) | 200 | 50 |
| 7. | Phenolic Mixture A | 400 | 35 |
| 8. | BHT/Xylenol Isomers (1:1) | 400 | 95 |
| 9. | BHT | 400 | 82 |
| 10. | BHT/TMDH (1:1) | 100 | 53 |

BHT = 2,6-di-t-butyl-4-methylphenol
TMDH = polymeric 2,2,4-trimethyl-1,2-dihydroquinoline
Phenolic Mixture "A" = mixture of 2,6-di-t-butylphenol (75%) and tert-butylphenol and tri-tertbutylphenol Another series of tests were undertaken using stripper gasoline from a Texas refinery (Table II).

TABLE II

| Additive | Dosage (ppm active) | Induction Time (minutes) |
|---|---|---|
| Control | — | 11 |
| Phenolic Mixture "A" | 100 | 17 |
| BHT/Xylenol Isomers (1:1) | 100 | 20 |
| BHT | 100 | 23 |
| BHT/TMDH (1:1) | 100 | 47 |

Dimate gasoline samples were utilized in conjunction with the tests reported in Tables III and IV.

TABLE III

| | Dimate Gasoline | |
|---|---|---|
| Additive | Dosage (ppm active) | Induction Time (minutes) |
| Control | — | 157 |
| Phenolic Mixture "A" | 50 | 449 |
| BHT/Xylenol Isomers (1:1) | 50 | 559 |
| BHT | 50 | 568 |
| BHT/TMDH (1:1) | 50 | 612 |

TABLE IV

| Additive | Dosage (ppm active) | Induction Time (minutes) |
|---|---|---|
| Control | — | 143 |
| PDP | 50 | 614 |
| BHT/TMDH (1:1) | 50 | 595 |
| BHT/XYlenol Isomers (1:1) | 50 | 514 |

PDP = para-phenylenediamine, N-phenyl-N'-(1,4-dimethyl pentyl)-p-phenylenediamine

DISCUSSION

The examples demonstrate that TMDH, by itself or in combination with a hindered phenol, serves as efficacious gasoline stabilizer in accordance with the above procedures. In fact, as shown in Table IV, the hindered phenol/TMDH (1:1) mixture performs almost as well as the well-known PDP antioxidant material.

While this invention has been described with respect to particular embodiments thereof, it is apparent that numerous other forms and modifications of the invention will be obvious to those skilled in the art. The appended claims and this invention generally should be construed to cover all such obvious forms and modifications thereof which are within the true spirit and scope of the present invention.

I claim:

1. A method of stabilizing gasoline mixtures comprising adding to said gasoline an effective stabilizing amount of an alkyl 1,2-dihydroquinoline or polymerized alkyl 1,2-dihydroquinoline, said alkyl 1,2-dihydroquinoline having the structure

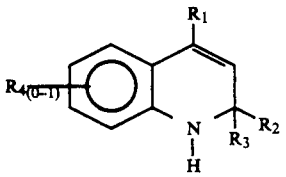

wherein $R_1$, $R_2$ and $R_3$ are the same or different and all chosen from H and $C_1$–$C_6$ lower alkyl, $R_4$, when present, is $C_1$–$C_{20}$ alkyl, or $C_1$–$C_{10}$ alkoxy.

2. A method as recited in claim 1 wherein said alkyl 1,2-dihydroquinoline comprises polymeric 2,2,4-trimethyl-1,2-dihydroquinoline (T.M.D.H.).

3. A method as recited in claim 2 wherein said TMDH is added in an amount of about 1.0 part to about 10,000 parts per million parts of said gasoline.

4. A method as recited in claim 3 wherein said TMDH is added to said gasoline in an amount of from 1.0 part to about 1500 parts per million of said gasoline.

5. A method as recited in claim 2 further comprising also adding to said gasoline an effective stabilizing amount of a hindered phenol compound.

6. A method as recited in claim 5 wherein said hindered phenol comprises the structure

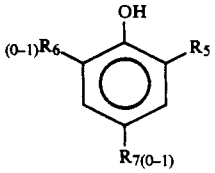

wherein $R_5$ and $R_6$, when present, may be the same or different with $R_5$ and $R_6$ being independently chosen and selected from the group of $C_1$–$C_6$ alkyl, $C_1$–$C_{30}$ alkaryl, and substituted $C_1$–$C_{30}$ alkaryl. $R_7$, when present, is selected from $C_1$–$C_{20}$ alkyl, thiophenol, thio substituted phenol, $C_1$–$C_{40}$ alkanoic acid ester, $C_1$–$C_{30}$ alkaryl, substituted $C_1$–$C_{30}$ alkaryl, $C_1$–$C_6$ alkylamino, $C_1$–$C_6$ alkoxy, amine, polynuclear aryl and substituted polynuclear aryl.

7. A method as recited in claim 6 wherein the molar ratio of TMDH:hindered phenol is from about 2:1 to 1:2 and wherein about 1 part to 10,000 parts of a combination of said TMDH and hindered phenol is added to said gasoline.

8. A method as recited in claim 7 wherein from about 1 to 1,000 parts of said combination is added to said gasoline.

9. A method as recited in claim 7 wherein said hindered phenol comprises 2,6-di-t-butyl phenol.

10. A method as recited in claim 6 wherein said hindered phenol comprises 2,6,-di-t-butyl-4-methyl phenol.

11. A method as recited in claim 7 wherein said hindered phenol comprises a mixture of 2,6-di-t-butyl-4-methylphenol and xylenol isomers.

12. A method as recited in claim 5 wherein said gasoline comprises straight-run distillate gasoline.

13. A method as recited in claim 5 wherein said gasoline comprises stripper gasoline.

14. A method as recited in claim 5 wherein said gasoline is produced by dimerization.

15. A method as recited in claim 5 wherein said gasoline comprises pyrolysis gasoline.

16. A method as recited in claim 2 wherein said polymeric TMDH has a degree of polymerization from about 2–5.

17. A method as recited in claim 6 wherein $R_7$ comprises a thio substituted phenol having the structure

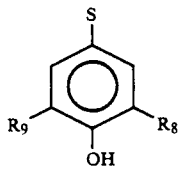

wherein $R_8$ and $R_9$ are independently chosen from $C_1$–$C_6$ alkyl.

* * * * *